United States Patent [19]

Sykes

[11] Patent Number: 4,881,393

[45] Date of Patent: Nov. 21, 1989

[54] WIRE COILING APPARATUS

[76] Inventor: Willard D. Sykes, 921 SW. 15th St., Forest Lake, Minn. 55025

[21] Appl. No.: 240,069

[22] Filed: Aug. 26, 1988

[51] Int. Cl.[4] ..... B21F 3/04; B21F 35/00

[52] U.S. Cl. ..... 72/27; 72/143; 72/144

[58] Field of Search ..... 72/135, 138, 142, 143, 72/144, 23, 27; 140/71 R, 71.5

[56] References Cited

U.S. PATENT DOCUMENTS

| | | | |
|---|---|---|---|
| 1,561,468 | 11/1925 | Jordan et al. | 72/143 |
| 2,290,380 | 7/1942 | Pierce | 72/144 X |
| 3,470,721 | 10/1969 | Scheublein et al. | 72/144 |
| 3,610,006 | 10/1971 | Scheublein et al. | 72/144 X |
| 4,084,420 | 4/1978 | Tsutsumino | 72/138 |
| 4,132,094 | 1/1979 | Missioux | 72/138 X |

FOREIGN PATENT DOCUMENTS

| | | | |
|---|---|---|---|
| 219383 | 1/1962 | Austria | 72/144 |

OTHER PUBLICATIONS

Winding of Metal Evaporator Charge Coils, Western Electric Technical Digest No. 45, Jan. 1977.

*Primary Examiner*—E. Michael Combs
*Attorney, Agent, or Firm*—Leo Gregory

[57] ABSTRACT

A wire coiling apparatus having a plurality of wire feeding spools, belts driving a wire coiling arbor, variable speed motors driving the belts and arbor, a lead screw moving the spools across the arbor feeding wire to be coiled on said arbor and a programmed computer coordinating the motors to determine the character of the coil produced.

6 Claims, 6 Drawing Sheets

WIRE COILING APPARATUS

BACKGROUND OF THE INVENTION

1. Field of Invention

This invention relates to a wire coiling apparatus.

2. Brief Description of The Prior Art

To the extent of the applicant's knowledge, spring or wire coiling machines are driven by means of gear trains which results in a very noisy mechanical operation.

With a gear train operation there is required to be a gear train alteration to change the pitch or angular relation of the coils or to alternate pitch or to have successive changes in pitch.

To alter a gear train means down time in stopping the operation of a machine and making the necessary mechanical gear changes. Micro changes in coiling a fine wire are difficult to achieve with an operation embodying a gear train drive.

SUMMARY OF THE INVENTION

This invention relates to an apparatus particularly designed to coil fine wire for medical use such as for vein insertions or artery insertions or implants.

More particularly the apparatus herein is subject to a programmable operation which embodies the use of a memory in which to enter and store motion sequences and embodies the use of a computer operated indexer to control coiling motions.

Further the apparatus herein embodies an arbor about which a wire is coiled, an array of spools carrying the wire to be wound, a lead screw advancing the spools to be abreast of the coiling and with the use of the indexer, the rotation of the arbor can be controlled to precise rotation segments, between precise angular positions of the coiling, or use a combination of such movements at a consistent or variable velocity.

It is also a purpose of the apparatus herein to be commanded and operated to produce to a combination of successive positions, motions, accelerations and decelerations and rotational velocities.

It is another purpose of the apparatus herein to embody micro stepping in its operation which permits the rotation of the arbor to be controlled in equal increments of movement such as one pulse of the motor drive rotating the arbor one angular increment.

It is the object herein to provide an apparatus particularly adapted to do fine resolution work which may be pre-programmed.

DESCRIPTION OF A PREFERRED EMBODIMENT

Figure 1:
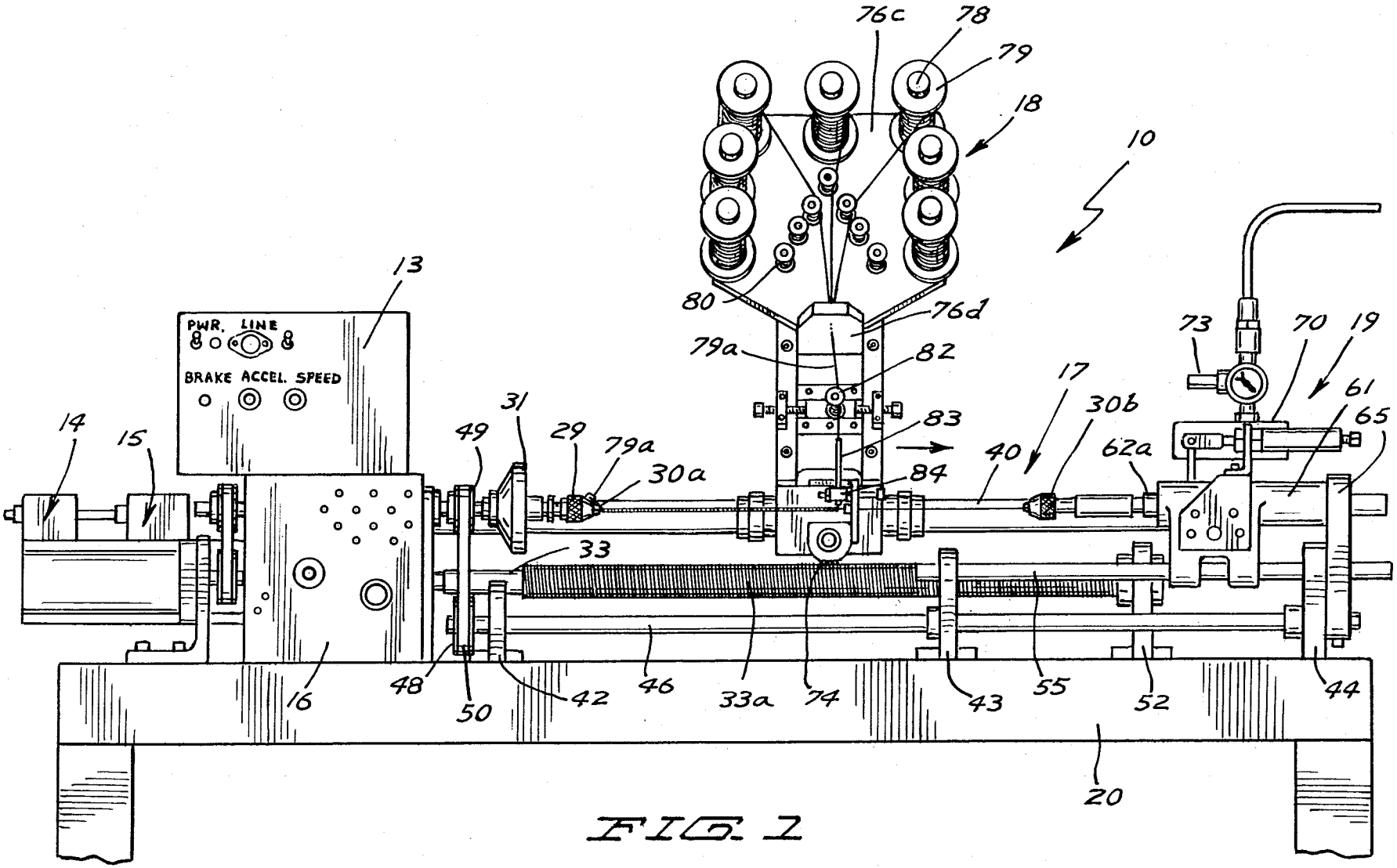
FIG. 1 is a plan view of the apparatus herein.

Referring to the drawings and more particularly to FIG. 1, the apparatus comprising the invention herein is indicated generally by the reference numeral 10.

Figure 5:
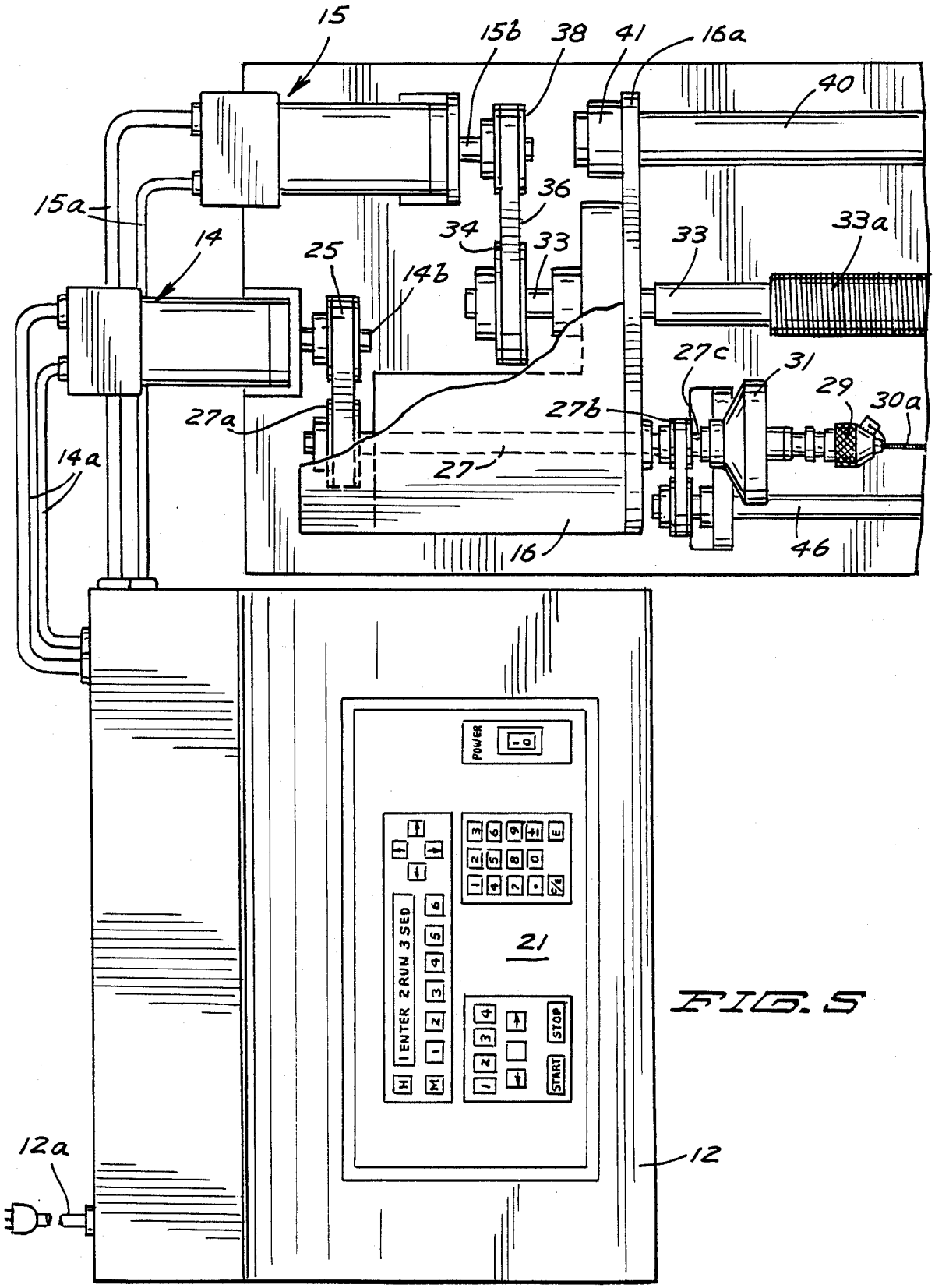
FIG. 5 is a top plan view of said last mentioned end portion showing a portion broken away.
Figure 6:
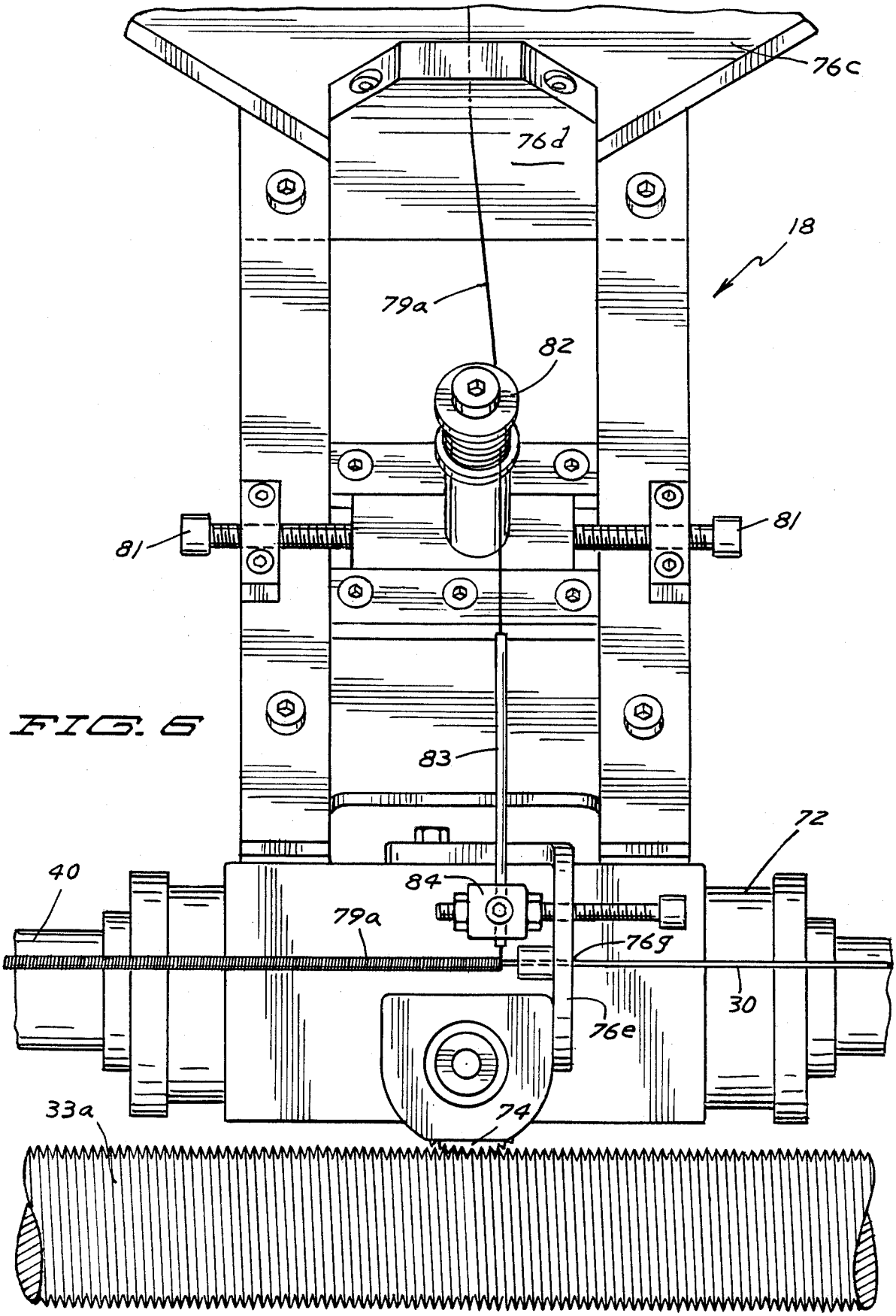
FIG. 6 is a view in elevation on an enlarged scale of a wire feeding spindle and related structure.

The apparatus comprises several major components, namely, the computer console 12 better shown in FIG. 5, an operating auxiliary control panel 13, the computer operated servo motors 14 and 15, the transmission chamber or bearing box 16, the operating shafts 17, a wire spool carrier 18 and a head stock or terminal bearing box 19.

Supporting said apparatus is a work table 20.

The computer 12 at one end of said table is a conventional piece of equipment bearing the trademark COMPUMOTOR 3000 INDEXING SYSTEM, made by the Parker Hannifin Co. of Petaluma, Calif. 94952, which is programmed to operate the servo motors 14 and 15. A particular run or wire coiling operation is programmed by operating the key pad 21 to provide the direction for the computer to operate said motors.

Said computer 12 is connected with a power source by line 12*a*.

The motors 14 and 15 are in circuit with said computer 12 by lines 14*a* and 15*a*. The shaft 14*b* of said motor 14 is shown extending outwardly thereof and carries at its end a grooved pulley 14*c* over which passes a belt 25.

Journaled in said bearing box 16 and extending outwardly thereof is a shaft 27 respectively having grooved pulley's 27*a* and 27*b* at the ends thereof as shown. The belt 25 passes over pulley 27*a*.

Mounted on the end 27*c* of said shaft 27, which extends through the pulley 27*b*, is a chuck 29 adapted to secure the end 30*a* of an arbor 30. Carried by said chuck to secure the leading end of a wire to be coiled about the arbor is a clip indicated by 29*a*. Mounted on said shaft 27*c* adjacent the end thereof is a cup-shaped stabilizing member 31.

Also journaled in said bearing box 16 extending therefrom is a shaft 33 having a threaded body portion 33*a* which forms a lead screw as will be described. The end portion 33 of said shaft in extending through said bearing box carries a pulley 34 over which passes a belt 36. The servo motor 15 has an extended shaft 15*b* carrying a pulley 38 and said belt passes thereover.

Extending through a flange portion 16*a* of said bearing box 16 is a smooth shaft 40 which is secured by a nut 41.

Upstanding from the front edge portion of said work table 20 are three vertically disposed bearing plates or brackets 42, 43 and 44 having extending therethrough and journaled therein a shaft 46. The portion of said shaft extending through the bearing bracket 42 carries a pulley 48.

Said arbor 30 on its portion between said chuck 29 and said bearing box 16 carries a pulley 49 and passing over said pulleys 48 and 49 is a belt 50. Thus the arbor 30 and the shaft 46 will rotate in unison.

Figure 2:
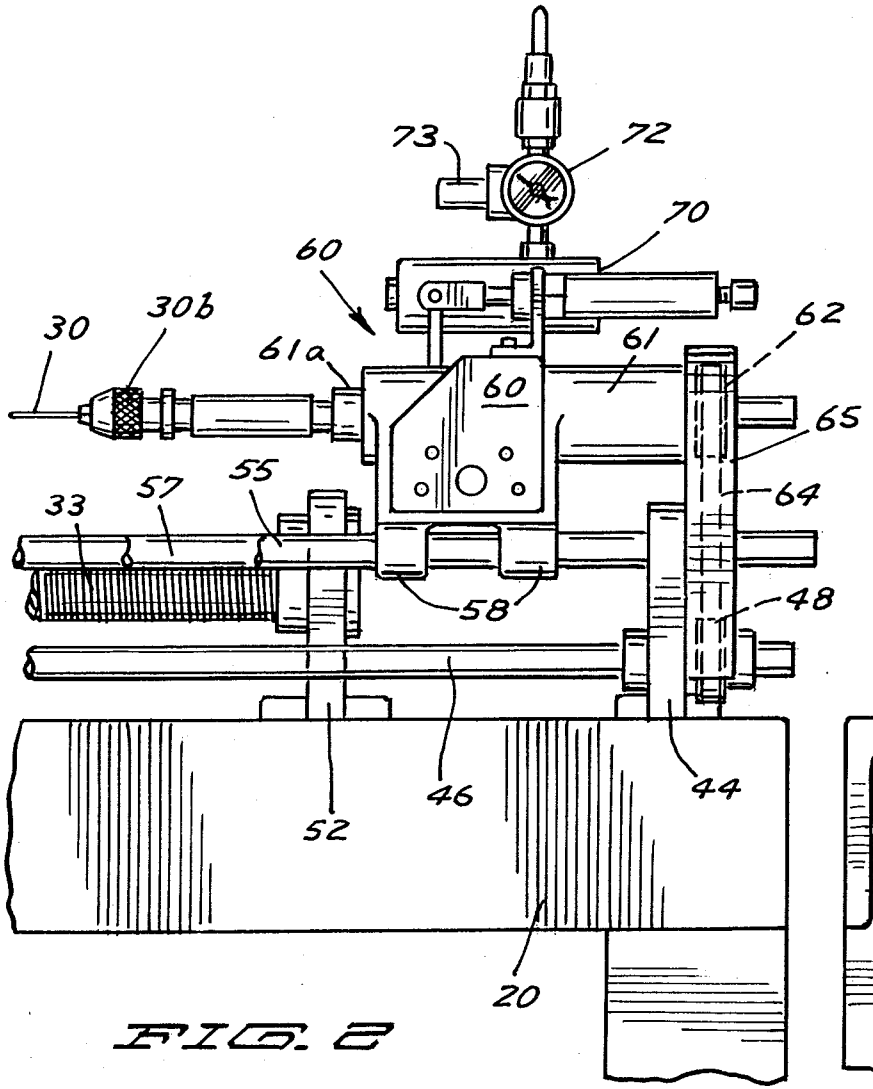
FIG. 2 is a broken view in plan on an enlarged scale of one end portion of the apparatus herein.

At its right hand end as viewed in FIGS. 1 and 2, said shaft 33 is journaled in a bearing bracket 52.

Said bearing bracket 44 extends transversely and has journaled into it the adjacent ends of shafts 55 and 57 which extend to the left as viewed in FIG. 1 to be journaled at their other ends in the bearing bracket 43. Carried on said shafts 55 and 57 by means of collar type bearings 58 and suitably secured is a mounting 60 having a pneumatic cylinder 61 which anchors by means of said chuck **30*b* the adjacent end of the arbor 30**. Said cylinder has a suitable air source not shown.

Said cylinder carries at its rear end portion a pulley 62 which is aligned with the pulley 48 carried by said shaft 46 and passing over said pulleys is a driving belt 64. Thus the arbor is uniformly rotated at each end thereof. A guard 65 is suitably mounted to overlie said belt.

Supported above said cylinder 61 by a bracket 68 and an extension 69 thereof is an electronic solenoid 70 having an operating knob 73 and a guage 72 to indicate the degree of tension placed on the arbor 30 by the linear adjustment of the piston **61*a* of the cylinder 61 and of the mounting 60**, if any. This is a conventional control arrangement.

Slidably mounted onto said shaft 40 and tilting forwardly to be supported by the shaft 46, to be described, is a carrier 18 having thereon a plurality of spools of wire for coiling.

The base portion of said carrier is formed as a casting 72 having a bore 73 extending transversely through the rear portion thereof and having the shaft 40 extending therethrough. A spur gear 74 is mounted at the front center portion of the base to engage the toothed portion **33*a* of the shaft 33**. Said base has a forward tilt.

Figure 3:
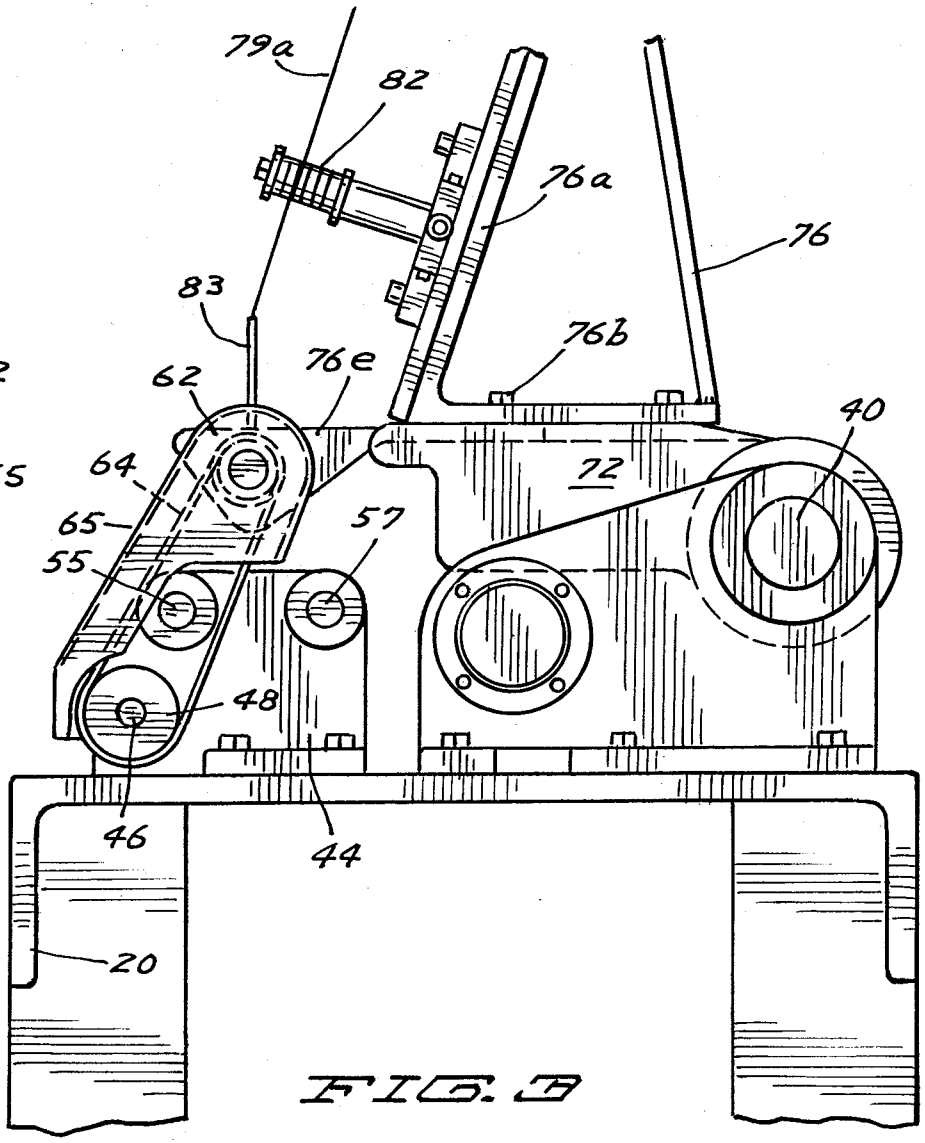
FIG. 3 is a view in end elevation of a fragmentary portion of a detail of the apparatus herein.

Upstanding from said base is a substantially triangular frame 76 as shown in FIG. 3, secured by bolts **76*b*. The face of said frame 76*a* is a plate member and the rear support may be a plate member or a pair of spaced rod-like legs, not here shown. Secured to the upper portion of the face plate 76*a* is a fairly wide substantially rectangular plate member 76*c* having a plurality of spaced pins 78 projecting therefrom, each bearing a spool of wire 79 disposed thereon. Mounted on said plate centrally between said spools are rollers 80 to align a wire or the wires being coiled from which the wire or wires, as the case may be, are passed through a suitably apertured guide plate 76*d* passing over a guide spool 82 mounted therebelow and from said spool the wire is shown passing through a tubular guide 83 held by a bracket 84 just above the arbor 30. Screws 81 position laterally said guide spool 82**.

Another guide or steady plate bracket **76*e* is mounted upon said base to extend forwardly to intersect the path of the arbor 30, the same being suitably apertured at 76*g* to have said arbor pass therethrough. The carrier 18 slides along the shaft 40 driven by the threaded shaft or lead screw 33**.

As indicated in FIG. 1, a single or several wires, as shown, from said spools 79 may be coiled at one time as represented by the wires **79*a***.

In the present embodiment with the arbor 30 being formed of a wire member of small dimension, the wire used to be coiled is particularly intended for medical purposes such as vein and artery probes or to form channels for the insertion of particular instruments. The wire is preferably on the order of 0.001 inches in diameter and may vary, for example, in the range of 0.001 to 0.030 inches diameter.

The apparatus described is adapted to drive the arbor up to 6000 RPM in a production run. The diameter of a coil to be produced may be on the order of 0.002 to 0.030 inches in diameter. The wire or rod forming the arbor will be of a diameter to accommodate the size of coil to be produced.

The illustrations of the coils in FIGS. 7–12 will be described in connection with the commentary on the operation.

Figure 4:
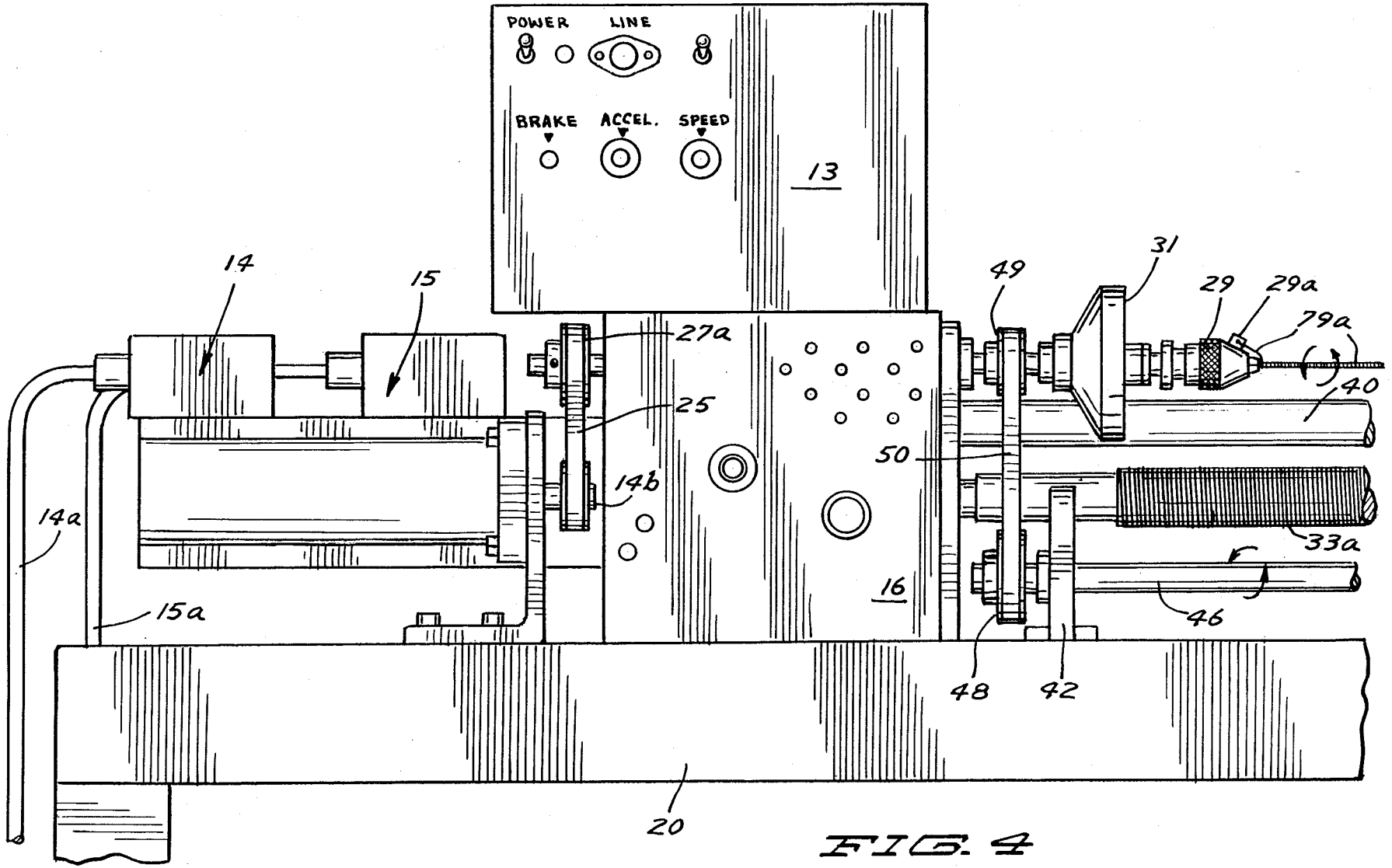
FIG. 4 is a view in elevation on an enlarged scale of the other end portion of the apparatus herein.

Referring to FIGS. 1, 4 and 5, the servo motor 14, as described, drives the arbor and the servo motor 15 drives the lead screw 33. The arbor and the lead screw rotate at the same speed to obtain a coil or as programmed, the servo motors in driving the arbor and lead screw at relative speeds, variations in coiling are obtained as to the pitch of the coils and to their spacing depending upon whether they are tightly or loosely coiled.

Figure 7:
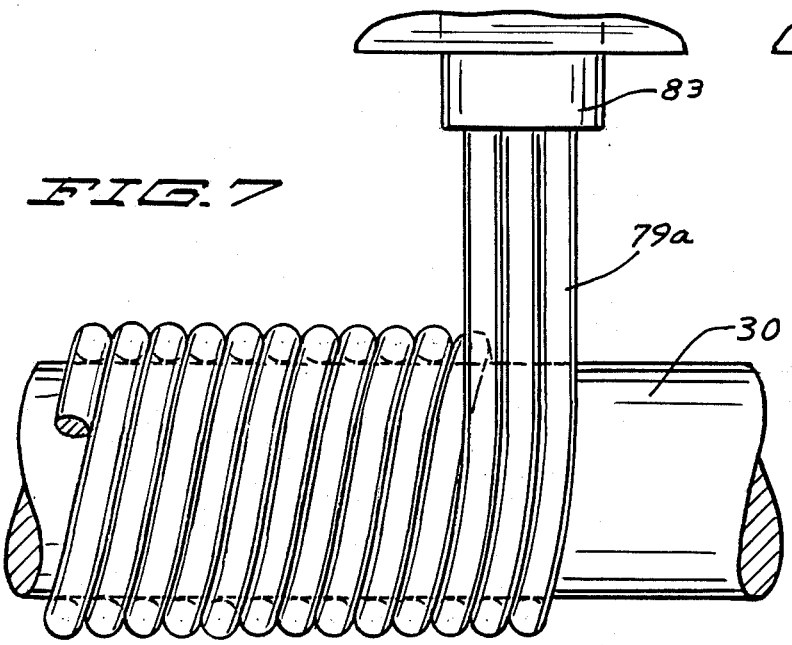
FIG. 7 is a fragmentary view in elevation showing a segment of a coil of wire on an enlarged scale.
Figure 8:
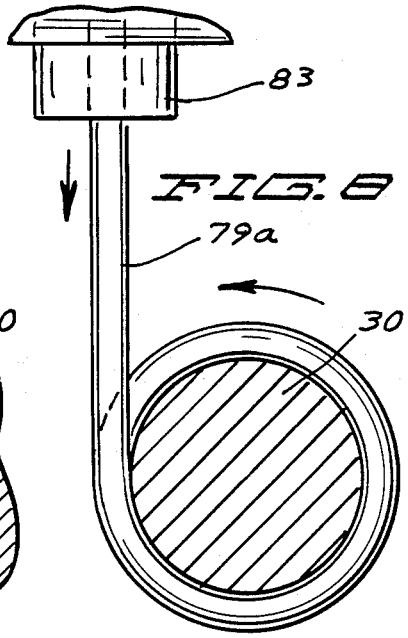
FIG. 8 is a view in end elevation of the coil of FIG. 7.
Figure 9:
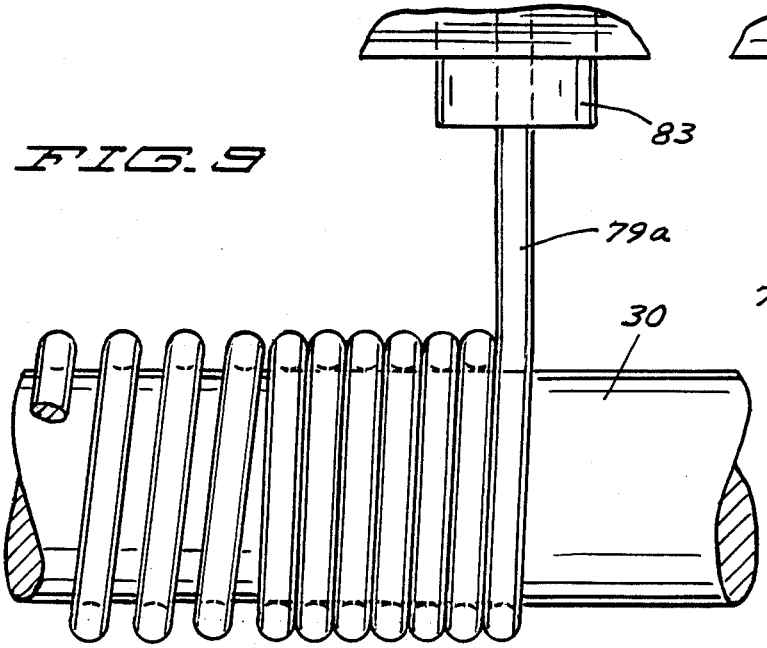
FIG. 9 is a view, similar to that of FIG. 7 showing a change in pitch in the same coil.
Figure 10:
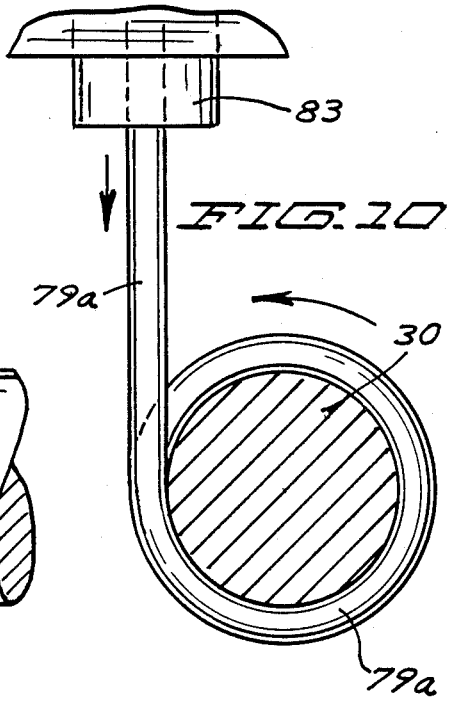
FIG.10 is a view in end elevation of the coil of FIG. 9.
Figure 11:
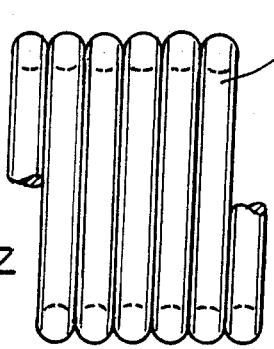
FIG.11 is a view in elevation of a segment of coiled wire on an enlarged scale.
Figure 12:
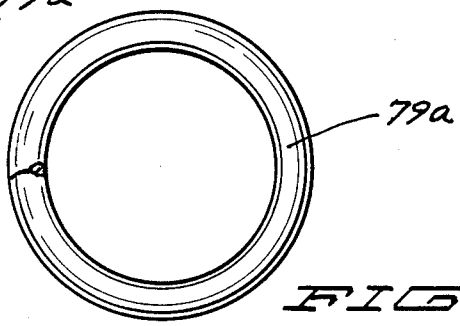
FIG.12 is an end view of the coil of FIG. 11.

The operator punches in his program for a run into the key pad 21 which includes speed of rotation, whether the entire run will be uniform as indicated in FIG. 7 or varied as indicated in FIG. 9. The arbor and the lead screw, according to the operation programmed, can vary the coiling in a given coiled wire or coiled wires, as the case may be. The length of the coiled wire is limited to the length of the arbor 30.

The computer is aware at all times of the speeds of the motors 14 and 15 whether they be the same or are relative to each other.

In starting a production run, the carrier will be moved to be adjacent the starting end of the arbor 30 and the wire or wires to be coiled are secured at their beginning ends to the clip **29*a***.

The key pad 21 is conventionally programmed and upon being programmed the start button on said pad is switched on to commence the operation of the servo motors 14 and 15 and the coiling operation of the apparatus.

There is a brief acceleration and deceleration period at the beginning and at the ending of a run to coil a wire to get up to production speed and to slow down to a stop. Thus there is on the order of a quarter inch of wire or less at the beginning and end of a run which may be regarded as waste.

It will be understood that the arbor is changeable to be of an appropriate diameter for the coil to be wound.

The auxiliary control panel is self explanatory in providing means to control the speed of rotation of the arbor and to vary the speed.

The apparatus has proven to be unusually successful in producing variations in pitch and spacing in coiling at programmed intervals without pause in the production run of a given coil of wire.

An unusual operating feature, which enhances the success of getting precisely the coil desired, is the arrangement of having belts drive the arbor uniformily at each end thereof.

The motor 14 simultaneously directly drives the arbor 30 at one end thereof by means of its shaft **27*c* and drives the shaft 46 at one end thereof by means of belt 50 and its other end said shaft by means of belt 65 drives the other or remote end of said arbor 30**. The arbor usually is a taut wire and could readily become twisted if not uniformily driven at each end as here done. This assures a coiling operation exactly as dictated by the programmed computer.

Prior art machines of which there is knowledge utilize gear trains as driving means instead of using belts.

The operation of such machines is very noisy whereas the apparatus comprising the invention herein is virtually silent in operation.

A gear train arrangement does not have the facility of the belt driven apparatus herein in being able to produce a length of coiled wire in which there may be several segments each having a distinct difference in pitch and coil spacing and may be varied as to tight or loose windup without a pause in the coiling operation. Further the operation herein is so precise that a coil may be varied at a distinct segment of rotation.

As indicated, the operation of the key pad of the computer is conventional and it is not seen that its specific operation requires description herein.

The use of the two program related servo motors taken with the belt drives give the apparatus herein significant economic advantage in producing practically any specifically required design of a coiled wire.

The tension on the arbor is readily and easily controlled by the pneumatic cylinder 61 as influenced by the electronic solenoid 70 in determining the tension on the arbor 30 and also by adjustment of the linear position of the mounting 60.

It will of course be understood that various changes may be made in the form, details, arrangement and proportions of the product without departing from the scope of the invention which, generally stated, consists in a product capable of carrying out the objects above set forth, in the parts and combination of parts disclosed and defined in the appended claims.

What is claimed is:

1. A wire coiling apparatus, having in combination an arbor, first and second belts directly and respectively engaging opposite ends of said arbor for rotating said arbor, a first servo motor driving said first and second belts, a lead screw parallel to said arbor, third and fourth belts directly and respectively engaging opposite ends of said lead screw for rotating said lead screw, a second servo motor driving said third and fourth belts, a programmed computer in operatively connected to said first and second servo motors for driving said motors at the same or relative speeds, an upstanding frame having a face for mounting a spool of coiling wire thereon, means mounted on said frame for feeding wire or a plurality of wires to said arbor, and said computer causing said servo motors within the continuous operation of coiling said wire or wires upon said arbor to produce variations in pitch and spacing thereof at programmed intervals in the process of a continuous coiling operation.

2. The structure of claim 1, including means adjusting the tension of said arbor.

3. The structure of claim 1, including means for stabilizing said arbor.

4. The structure of claim 1, wherein said face of said frame disposed parallel to said arbor, and mounted upon said face are a plurality of spools of coiling wire.

5. The structure of claim 4, wherein said spools are positioned at right angles to said arbor.

6. The structure of claim 1, including idler shafts respectively extending between and supporting said first, second, third and fourth belts respectively rotating said arbor and said lead screw.

* * * * *